US005640774A

United States Patent [19]

Goldman

[11] Patent Number: 5,640,774

[45] Date of Patent: Jun. 24, 1997

[54] DIET AID DEVICE AND METHOD

[76] Inventor: Millicent F. Goldman, 538 Croton Heights Rd., Yorktown Heights, N.Y. 10598

[21] Appl. No.: 494,807

[22] Filed: Jun. 26, 1995

[51] Int. Cl.[6] ..... G06C 3/00; G06C 27/00

[52] U.S. Cl. ..... 33/15 D; 116/318; 116/316; 235/116; 434/127; 434/206

[58] Field of Search ..... 33/15 D, 1 C, 33/15 B, 1 BB; 116/318, 316; 235/114, 116, 122, 78 R, 78 A; 364/413.29, 709.03; 434/127, 206; D10/97; D18/10

[56] References Cited

U.S. PATENT DOCUMENTS

| | | | |
|---|---|---|---|
| 2,467,360 | 4/1949 | Young | 33/1 SD |
| 2,748,514 | 6/1956 | Sulger | D10/97 |
| 3,432,927 | 3/1969 | Springer | 33/1 SD |
| 3,572,585 | 3/1971 | Weaver | 434/127 |
| 4,599,508 | 7/1986 | Smetaniuk | 235/116 |
| 5,178,416 | 1/1993 | Wennik | 434/127 |
| 5,382,165 | 1/1995 | Knox | 434/127 |

*Primary Examiner*—Christopher W. Fulton
*Attorney, Agent, or Firm*—John H. Crozier

[57] ABSTRACT

In a preferred embodiment, a diet aid device, including: apparatus to indicate a net calorie intake goal; apparatus to indicate remaining calories to reach the goal; and apparatus to decrease the remaining calories to reach the goal as calories are consumed.

12 Claims, 5 Drawing Sheets

DIET AID DEVICE AND METHOD

BACKGROUND OF THE INVENTION

1. Field of the Invention

The present invention relates to diet aid devices generally and, more particularly, but not by way of limitation, to a novel diet aid device and method which permit simple and accurate record-keeping of calories consumed and expended.

2. Background Art

An important aspect of maintaining physical fitness is to track net calorie intake, usually on a daily basis, and comparing this to a standard table of rates of calorie intake versus such factors as age, sex, and weight. It is known that some conventional calculators have been adapted to receive inputs of calories consumed and total the same over a period of time. However, no such calculators are known which permit simple and accurate record-keeping of net calories consumed in food and drink and expended by exercise and comparing this total to a predetermined goal.

Accordingly, it is a principal object of the present invention to provide novel diet aid device and method which permit simple and accurate record-keeping of calories consumed and expended.

It is a further object of the invention to provide such a device and method that are easy to use.

It is an additional object of the invention to provide such a device that is economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a diet aid device, comprising: means to indicate a net calorie intake goal; means to indicate remaining calories to reach said goal; and means to decrease said remaining calories to reach said goal as calories are consumed.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 5:
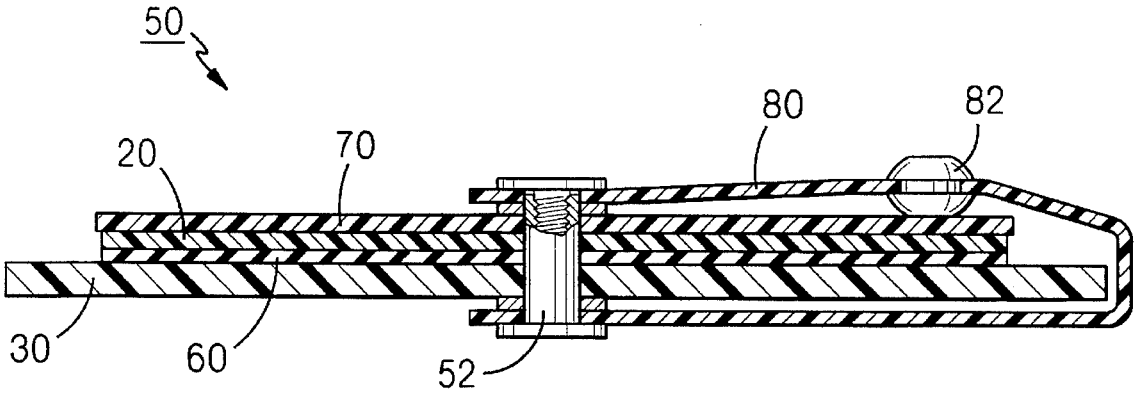
FIG. 5 is a cross-sectional view of the device.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 1:
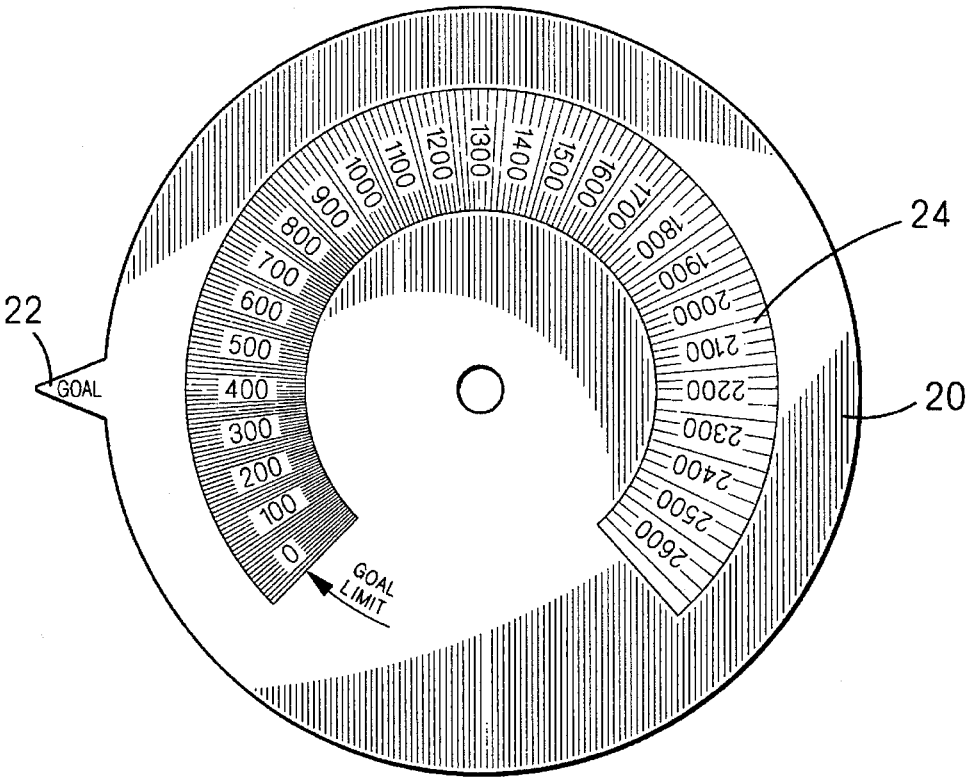
FIG. 1 is a top plan view of a goal indicator disk employed in the present invention.

Referring now to FIG. 1, there is illustrated a goal indicator disk 20 having formed at the edge thereof a goal pointer 22 and having printed thereon a scale 24 which, as the use of the same will be described in detail below, gives total calories from 0 to 2600. The scale is gradually shaded so that the higher numbers have a yellow background, while the intensity of the background increases or changes color until it is a very bright red in the region of the lower numbers.

Figure 2:
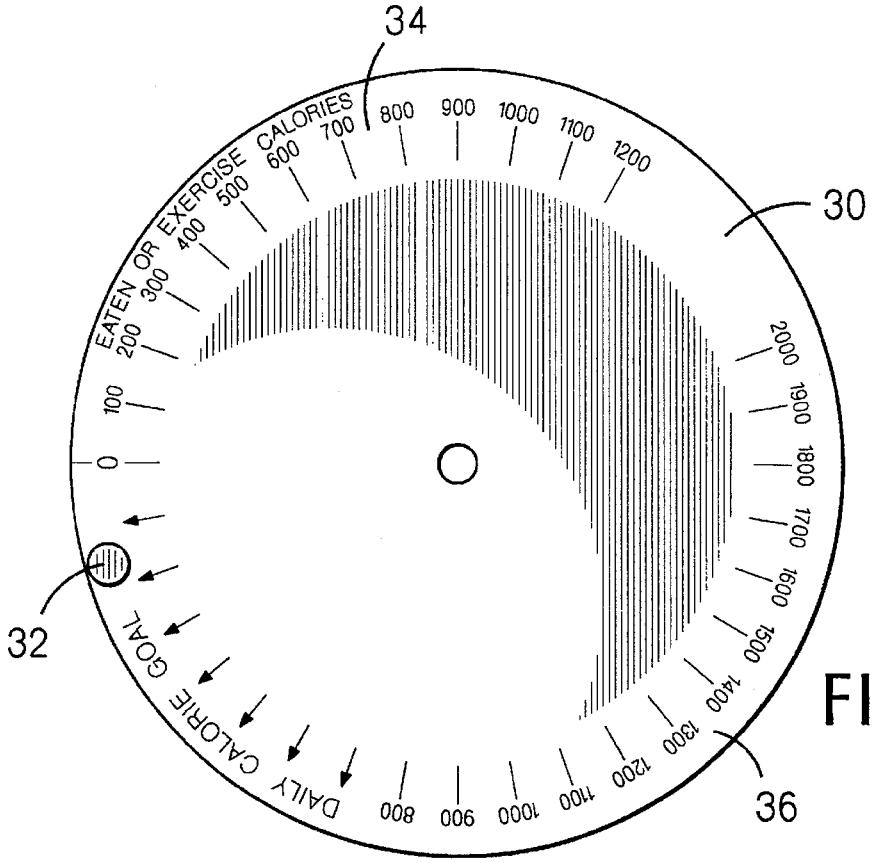
FIG. 2 is a top plan view of a back disk employed in the invention.

FIG. 2 illustrates a back disk 30 having a vertical stop pin 32 and having printed thereon two scales: one scale 34 indicating calories eaten or expended during exercise and the other scale 36 indicating daily calorie goal.

Figure 3:
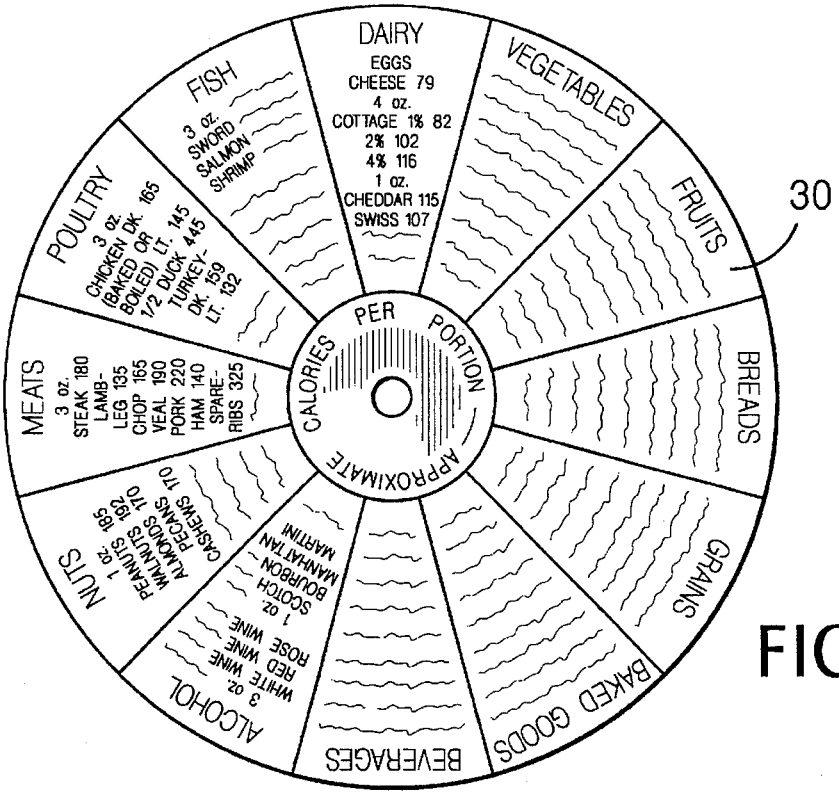
FIG. 3 is a bottom plan view of the back disk of FIG. 2.

FIG. 3 illustrates the reverse side of back disk 30 on which is printed a chart giving caloric contents of various comestibles.

Figure 4:
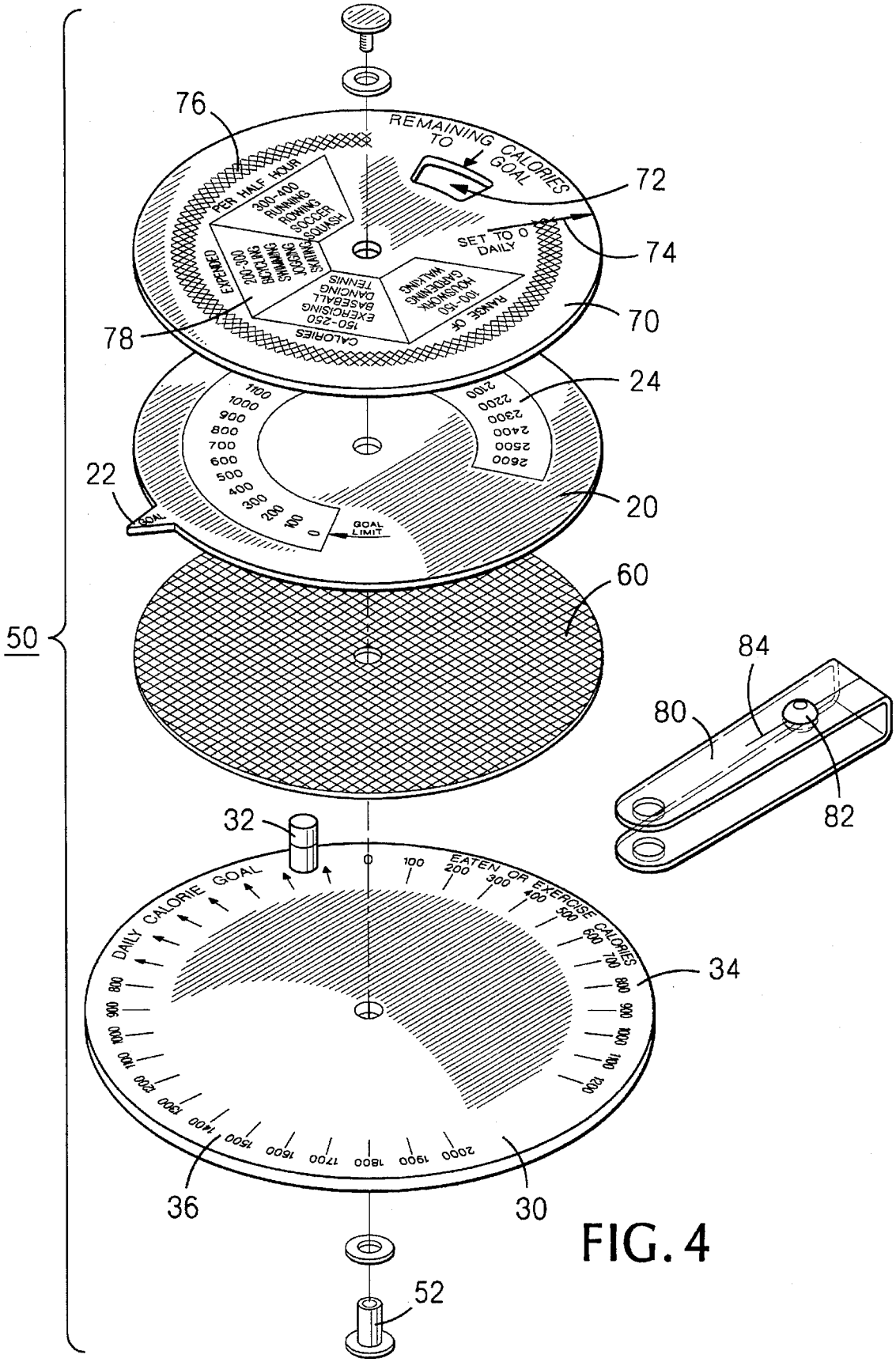
FIG. 4 is an exploded isometric view of the device of the present invention.
Figure 7:
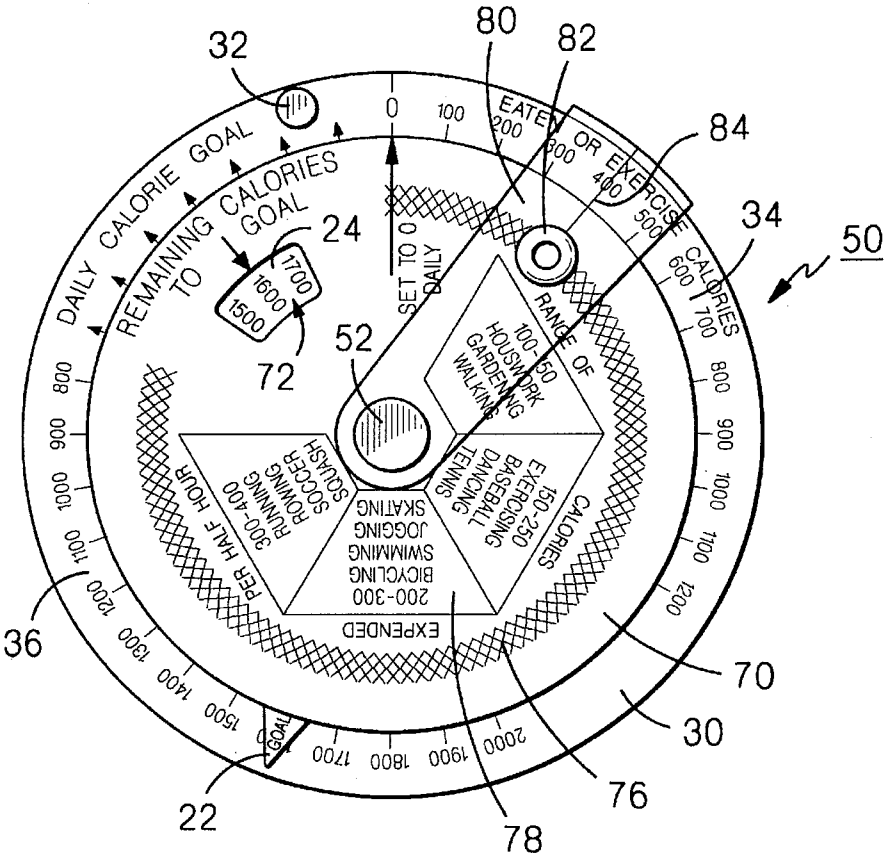
FIGS. 6–9 are top plan views of the device showing steps in the record-keeping of net calories consumed and expended.
Figure 6:
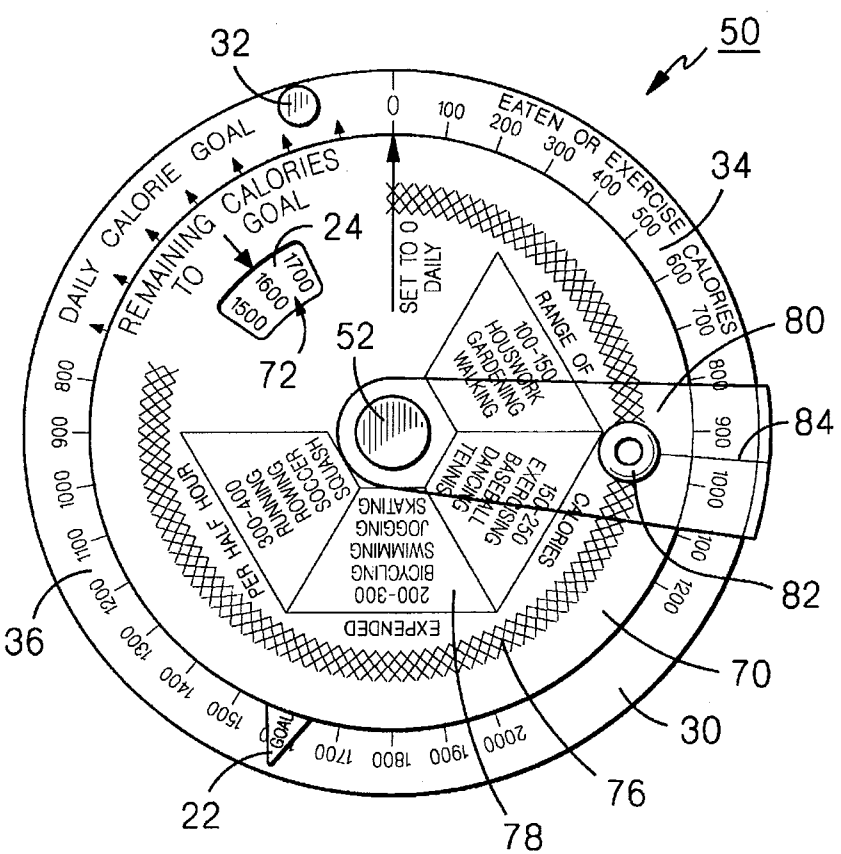
Figure 9:
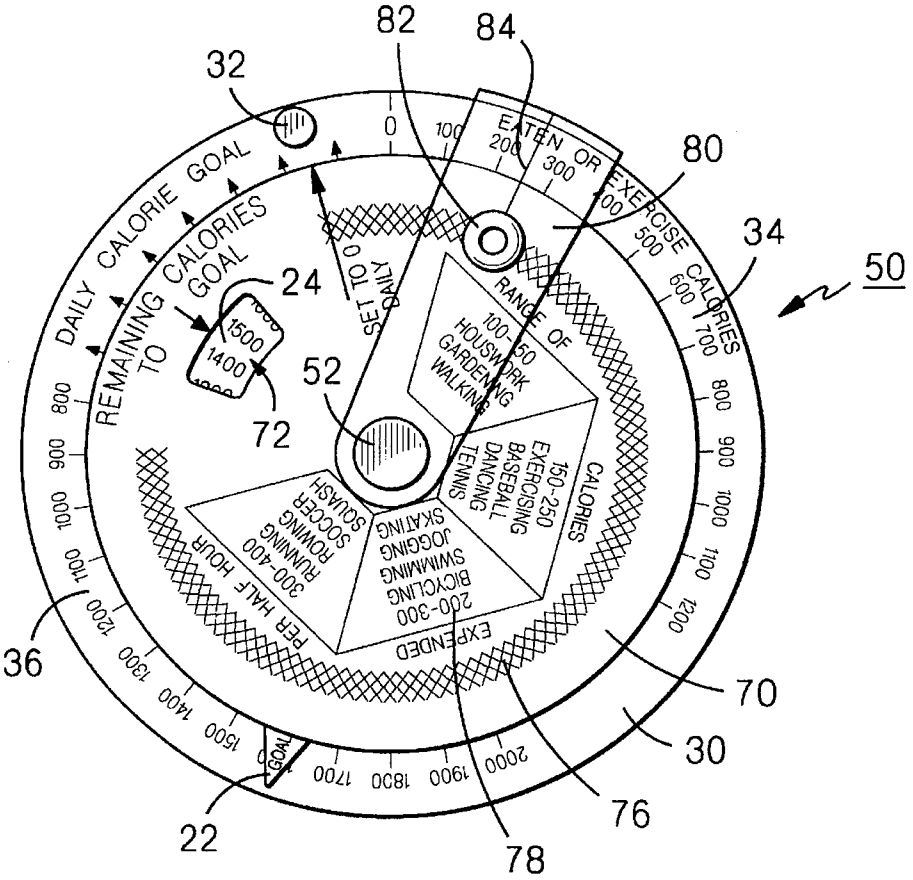
Figure 8:
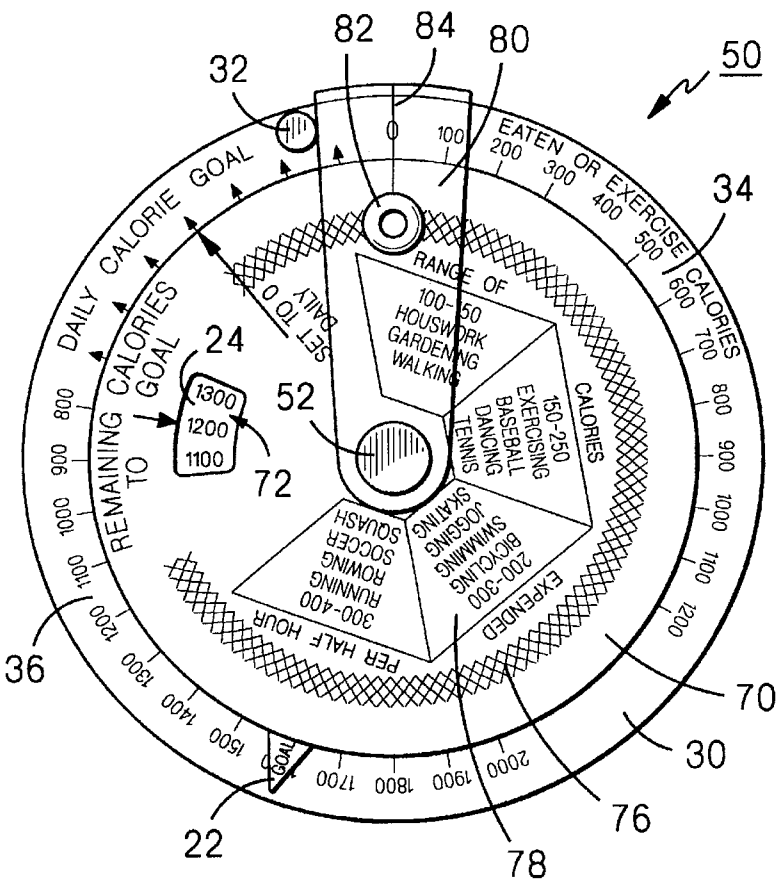

FIG. 4 illustrates all the elements of the device of the present invention, generally indicated by the reference numeral 50, the elements being rotatably fastened together by means of a screw or other type of fastener 52. In addition to the elements described above, device 50 includes a circular rubber sheet 60 disposed between goal indicator disk 20 and back disk 30 to prevent these two disks from easily rotatably shifting with respect to each other, but permitting relative rotational realignment with some applied force. An accumulator disk 70, disposed on top of goal disk 20, has defined therethrough an opening 72 labeled "REMAINING CALORIES TO GOAL", a "SET TO 0 DAILY" arrow 74, a roughened arcuate path 76, and a chart 78 giving calories expended for various activities. A U-shaped, clear plastic shifter 80 surrounds the various disks of device 50 and has a rubber grommet 82 extending through its upper surface and a radial indicator line 84 printed on its upper surface. Pressing down on grommet 82 will cause the grommet to engage roughened arcuate path 76 of accumulator disk 70 so that the accumulator disk can be easily rotated relative to goal disk 20. Releasing pressure on grommet 82 permits shifter 80 to be freely rotated relative to accumulator disk 70, with some slight pressure holding the accumulator disk in place if necessary.

FIG. 5 illustrates the elements of device 50 in assembled relationship.

FIGS. 6–9 illustrate the use of device 50 in record-keeping for eaten or exercise calories compared to a goal. Say, for example, that a user has a net intake goal of 1600 calories per day. Accordingly, goal disk 20 is rotated relative to back disk 30 so that goal pointer 22 on the goal disk points to "1600" on scale 36 on the back disk and accumulator disk 70 is rotated so that "SET TO 0 DAILY" arrow 74 points to zero on scale 34 of back disk 30, thus aligning the arrow at opening 72 to point to "1600" on scale 24 on goal disk 20, all as shown on FIG. 6.

Then, assume that the user eats a breakfast containing 400 calories. With all other elements held stationary, shifter 80 is rotated so that indicator line 84 points to "400" on scale 34, as is shown on FIG. 7. Then, pressure is applied to grommet 82 and accumulator disk 70 is rotated until indicator line 84 points to "0" on scale 34, with an edge of shifter 80 engaging stop pin 32. This causes "REMAINING CALORIES TO GOAL" to decrement to "1200" calories on scale 24, as is shown on FIG. 8.

Now, assume that the user engages in exercise which expends 250 calories. Then, grommet 82 is pressed to engage accumulator disk 70 and shifter 80 is rotated until indicator line points to "250" on scale 34. This causes "REMAINING CALORIES TO GOAL" to increment to "1450" on scale 24, as shown on FIG. 9.

Thus, in like manner, the user continues to subtract calories from "REMAINING CALORIES TO GOAL" as food and drink are consumed and to add calories to "REMAINING CALORIES TO GOAL" as calories are expended during exercise. In addition to providing a simple and easy method of record-keeping, observing the net calories during a day encourages a user to expend calories during physical activity in order to increase the calories that may be consumed. The shading or color change on scale 24 aids in alerting the user to the approach of reaching the calorie goal.

While the present invention has been described in the context of dieting and weight loss, it will be understood that it may be employed, as well, by a person who is setting caloric intake at a predetermined level in order to gain weight. Also, the target goal may be adjusted on a weekly basis, for example, to take into account a person exceeding, or failing to meet, a weight goal for the preceding week.

The elements of device 50 may be economically constructed of suitable polymeric materials using conventional techniques. Device 50 preferably has a diameter of about 3½ to 4 inches so that it may be conveniently carried in a shirt pocket or purse for easy access and use.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A diet aid device, comprising:

(a) first means to display a first value indicating a net calorie intake goal;

(b) second means, coupled to said first means, to display a second value indicating remaining calories to reach said goal; and (c) third means, coupled to said second means, to cause a decrease in said second value as calories are consumed.

2. A diet aid device, as defined in claim 1, further comprising: said third means also to cause an increase in said second value as calories are expended.

3. A diet aid device, as defined in claim 1, wherein said second and third means comprise:

(a) a first substrate having thereon a first scale indicating said remaining calories;

(b) a second substrate superjacent said first substrate and having means to view said remaining calories on said first scale; and (c) means to move said second substrate relative to said first substrate a distance representing calories consumed so as to decrease the value of remaining calories viewed an amount equal to said calories consumed.

4. A diet aid device, as defined in claim 3, wherein said means to move comprises: a shifter selectively freely moveable with respect to said second substrate or causing said second substrate to move with said shifter, said shifter being freely moved to be alignable with a second scale indicating calories consumed, with return of said shifter to a zero position while causing said second substrate to move with said shifter causing said decrease in the value of remaining calories viewed through said opening.

5. A diet aid device, as defined in claim 4, wherein:

(a) said shifter causes said second substrate to move with said shifter by means of applying pressure to frictional material mounted in said shifter and engaging a surface of said second substrate; and (b) said shifter moves freely with respect to said second substrate by moving said shifter without applying pressure to said frictional material.

6. A diet aid device, as defined in claim 3, wherein:

(a) said first and second substrates are superjacent a third substrate;

(b) said third substrate has thereon a second scale indicating calories consumed and a third scale indicating net calorie intake goals; and (c) said first substrate includes pointer means to indicate a specific net calorie intake goal.

7. A diet aid device, as defined in claim 6, wherein: said first, second, and third substrates are circular disks.

8. A diet aid device, as defined in claim 7, further comprising: frictional means disposed between said first and third substrates.

9. A diet aid device, as defined in claim 1, wherein: said second means includes background shading increasing in intensity from higher values to lower values along said second means.

10. A diet aid device, comprising:

(a) means to indicate a net calorie intake goal;

(b) means to indicate remaining calories to reach said goal; and (c) means to decrease said remaining calories to reach said goal as calories are consumed;

wherein: said means to indicate remaining calories and said means to decrease said remaining calories comprise:

(d) a first circular disk having thereon a first scale indicating said remaining calories;

(e) a second circular disk superjacent said first substrate and having means to view said remaining calories on said first scale;

(f) said first and second circular disks are superjacent a third circular disk;

(g) said third circular disk has thereon a scale indicating net calorie intake goals and a scale indicating calories consumed; and (h) said first circular disk includes pointer means to indicate a specific net calorie intake goal;

and wherein said diet aid device further comprises:

(i) frictional means disposed between said first and third circular disks.

11. A diet aid device, as defined in claim 10, wherein said means to move comprises: a shifter selectively freely moveable with respect to said second substrate or causing said second substrate to move with said shifter, said shifter being freely moved to be alignable with said scale indicating calories consumed, with return of said shifter to a zero position while causing said second substrate to move with said shifter causing said decrease in the value of remaining calories viewed through said opening.

12. A diet aid device, as defined in claim 11, wherein:

(a) said shifter causes said second substrate to move with said shifter by means of applying pressure to frictional material mounted in said shifter and engaging a surface of said second substrate; and (b) said shifter moves freely with respect to said second substrate by moving said shifter without applying pressure to said frictional material.

* * * * *